US005983473A

United States Patent [19]

Yuguchi et al.

[11] Patent Number: 5,983,473

[45] Date of Patent: Nov. 16, 1999

[54] REINFORCING BAR BINDING MACHINE

[75] Inventors: Sadao Yuguchi, Sanda; Akio Oowari, Toyama, both of Japan

[73] Assignee: Kabushiki Kaisha Kanzaki Shokai, Osaka, Japan

[21] Appl. No.: 08/930,612

[22] PCT Filed: Jul. 1, 1996

[86] PCT No.: PCT/JP96/01831

§ 371 Date: Oct. 15, 1997

§ 102(e) Date: Oct. 15, 1997

[87] PCT Pub. No.: WO97/34065

PCT Pub. Date: Sep. 18, 1997

[30] Foreign Application Priority Data

Mar. 15, 1996 [JP] Japan ..... 8-059622

[51] Int. Cl.[6] ..... B23P 19/04; B21F 15/04

[52] U.S. Cl. ..... 29/33 F; 140/119

[58] Field of Search ..... 29/33 F, 566.1; 140/93.6, 93 A, 119

[56] References Cited

U.S. PATENT DOCUMENTS

| | | | |
|---|---|---|---|
| 4,117,872 | 10/1978 | Gött et al. | 140/93.6 X |
| 4,252,157 | 2/1981 | Ohnishi | 140/93 A |
| 4,354,535 | 10/1982 | Powell et al. | 140/93 A |
| 4,362,192 | 12/1982 | Furlong et al. | 140/119 X |
| 4,798,231 | 1/1989 | Glaus et al. | 140/119 |
| 5,431,196 | 7/1995 | Forrester, Jr. et al. | 140/93.6 |
| 5,682,927 | 11/1997 | Takahashi et al. | 140/119 |

FOREIGN PATENT DOCUMENTS

| | | |
|---|---|---|
| 4-201807 | 7/1992 | Japan . |
| 5-13223 | 2/1993 | Japan . |
| 8-114034 | 5/1996 | Japan . |

*Primary Examiner*—William Briggs
*Attorney, Agent, or Firm*—Nikaido, Marmelstein, Murray & Oram LLP

[57] ABSTRACT

A reinforcing bar binding device of simple structure and light weight capable of preventing exposure of wire from concrete which may cause corrosion of reinforcing bar, by reducing the height of the twisted portion of a wire rope, comprising a main body 1, and a loop forming unit 3 having a pair of curved members 2A, 2B with grooves disposed at the leading end of the main body 1 so as to be free to open and close, in which the main body 1 comprises a wire feeder 5 for forming a loop of wire 4 by feeding the wire 4 into the grooves of the pair of curved members 2A, 2B in a closed state so as to enclose the intersection of reinforcing bars 60, and a driving mechanism 6 incorporating a motor 21 for opening or closing the pair of curved members 2A, 2B and, after forming the loop, advancing and retracting a cutter 36 for cutting off the wire 4 being sent out to the grooves, twisting the formed loop, and advancing, retracting and rotating a pair of pin members 37 disposed at an interval for binding the reinforcing bars 60 by the wire 4, sequentially.

11 Claims, 13 Drawing Sheets

REINFORCING BAR BINDING MACHINE

BACKGROUND ART

The present invention relates to a portable reinforcing bar binding device for binding reinforcing bars, laid down laterally and longitudinally at construction sites, by a wire at their intersections.

Hitherto, as the means for improving the reinforcing bar binding work at construction sites, a reinforcing bar binding device as shown in FIG. 29 has been proposed (Japanese Patent Publication No. 5-13223). This reinforcing bar binding device has a J-shaped loop forming unit 102 provided at the leading end of a main body 101, and a wire reel 103 provided at the rear part of the main body 101, and the loop forming unit 102 is moved back and forth by a reciprocal driving mechanism 104, and a wire 105 is sent out from the wire reel 103 by a pair of pinch rollers 107 driven by a motor 106. This wire 105 is further fed into the loop forming unit 102 through a bar-shaped wire twisting unit 110 rotated by a wire cutter 108 driven by solenoid or the like, not shown, and a motor 109. The intersection of reinforcing bars 111 is placed in the loop forming unit 102 in opened state, and the loop forming unit 102 is moved back to close, and the wire 105 is supplied in the loop forming unit 102 to form a wire loop 112, and the wire 105 is cut by the wire cutter 108, and the wire loop 112 is twisted by the wire twisting unit 110.

Furthermore, in other reinforcing bar binding device (Japanese Laid-open Utility Model No. 5-3495 (a microfilm of Japanese Utility Model Application No. 3-51320), by a drive mechanism composed of motors, gears, cams, clutches, rollers, and others, a wire is supplied from the wire reel into the J-shaped loop forming unit to form a wire loop, the wire is cut off, and the wire loop is twisted, and in this reinforcing bar binding device, after supplying the wire into the loop forming unit, it is cut off by a cutter provided near the i-shaped leading end, and the wire loop is formed by hooking and twisting by a hook provided in the bar-shaped wire twisting unit.

In the case of the first reinforcing bar binding device disclosed in Japanese Patent Publication No. 5-13223, four driving devices are used, that is, the reciprocal driving device 104, motor 106, solenoid, and motor 109. As a result, the device is not only bulky but also heavy, and the efficiency of the reinforcing bar binding work by this device is, hence, poor. Besides, the loop is twisted by the bar-shaped loop twisting unit 110. That is, the loop is twisted at its one point. Accordingly, only the portion closer to the loop twisting unit 110 is easily twisted, and the height of the twisted portion of the loop is increased. As a result, when the reinforcing bar is buried in concrete, this wire twisted portion is exposed, and corrosion of reinforcing bar may be originated from this exposed portion. Moreover, the intersection of reinforcing bars must be bound by forming loops plural times by the wire, but in the case of this reinforcing bar binding device, it seems difficult to form loops of wire plural times.

In the case of the second reinforcing bar binding device mentioned above, after forming a wire loop, the wire is cut off near the leading end of the J-shaped loop forming unit considerably remote from the loop twisting unit. Accordingly, according to the example disclosed in the microfilm of Japanese Utility Model Application No. 3-51329, at least ¾ of the periphery of the wire loop is displaced out of the twisted portion of the wire, and it is a wasteful portion.

In this reinforcing bar binding device, too, same as in the first reinforcing bar binding device, the wire loop is twisted at its one point by the bar-shaped loop twisting unit. Accordingly, same as above, the twisted portion of the wire loop is high, and the wasteful portion is further extended above the twisted portion, and the wire is exposed from the concrete, which gives rise to corrosion of reinforcing bar.

Moreover, in this reinforcing bar binding device, various mechanical elements are used in the driving mechanism, such as motor, gears, cam, clutch and rollers, and the structure is too much complicated.

The invention is devised to solve the problems of such prior arts, and it is an object thereof to present a reinforcing bar binding device of simple structure and light weight, capable of preventing exposure of wire from the concrete which may cause corrosion of reinforcing bar, by reducing the height of the twisted portion of wire.

DISCLOSURE OF THE INVENTION

To solve the problems, a first invention comprises a main body, and a loop forming unit having a pair of curved members with grooves disposed at the leading end of the main body so as to be free to open and close, wherein the main body comprises a wire feeder for forming a loop of wire by feeding a wire into the grooves of the pair of curved members in a closed state so as to enclose the intersection of reinforcing bars, and a driving mechanism incorporating a motor for opening or closing the pair of curved members, and, after forming the loop, advancing and retracting the cutter for cutting oft the wire being sent out to the grooves, twisting the formed loop, and advancing, retracting and rotating a pair of pin members disposed at an interval for binding the reinforcing bar by the wire, sequentially.

In a second invention, the pair of curved members are formed so as to operate by a link mechanism, and the driving mechanism comprises a first male thread member driven and rotated by the motor, a second male thread member disposed parallel to the first male thread member, driven and rotated by the motor through this first male thread member, a first annular portion having a female thread portion to be engaged with the first male thread member, and plural protrusions extending in the axial direction on the outer circumference for moving in the direction departing from the loop forming unit, that is, backward, when the first male thread member rotates normally, relatively to the female thread portion, being coupled to the link mechanism through an intermediate member, for closing the curved members by moving backward, and opening the curved members by moving forward in the direction toward the loop forming unit, a second annular portion having a female thread portion to be engaged with the second male thread member, and plural protrusions extending in the axial direction on the outer circumference for moving forward when the second male thread member rotates relatively along with the normal rotation of the first male thread member, being formed to be free to advance and retract integrally with the cutter and pin members, and to rotate integrally, for advancing the cutter by moving forward to move over the wire cutting position, and projecting the pin members to the position for twisting the loop, a pair of first pawl members to be engaged and disengaged with the protrusions of the first annular portion, for restraining the normal rotation of the first annular portion and allowing to move in a direction along the shaft in a first state which is an initial state before start of reinforcing bar binding work, moving from the position in the first state, hitting against the rear stopper, allowing to move in a forward direction toward the first annular portion restrained of the move in the backward direction, restraining reverse rotation and allowing normal rotation in a second state, and holding the second in third and fourth states, and a fifth state returning to the first state, a pair of second pawl members to be engaged and disengaged with the protrusions of the second annular portion, for restraining the rotation of the second annular portion and allowing to move in an axial direction in the first, second and third states, and allowing rotation of the second male thread member along the normal rotation of the first male member and rotation of the second annular portion in the same direction, restraining the rotation of the second annular portion in the opposite direction thereof, hitting against the front stopper after moving from the position in the third state, and allowing to move in the backward direction toward the second annular portion restrained of the move in the forward direction in the fourth and fifth states, and a head unit having a guide unit for sliding the cutter and pin members, and also having a guide groove for guiding the wire toward the inlet of the loop forming unit on the front surface, being provided rotatably together with the pin members, wherein normal rotation of the first male thread member from the first state in which the first annular portion is at the advanced position and the second annular portion is at the retracted position causes to change to the second and third states, further normal rotation of the first male thread member to the fourth state, further normal rotation of the first male thread member to the fifth state, and the subsequent reverse rotation of the male thread member causes to move to the first state.

In a third invention, the guide groove of the head unit has an overhang portion projecting above the groove, at the outlet unit and at the advanced side when the head rotates for twisting the loop, and is inclined forward along the wire advancing direction.

In a fourth invention, the front part of the head unit is formed as a slope so that the side wall of the guide groove may be lower toward the end portion, in the inlet side and outside side follower side portions when the head rotates for twisting the loop.

In a fifth invention, the loop forming unit comprises a stationary guide member having a guide surface which is inclined in the same direction as the bottom of the inlet of the groove at the inlet side of the groove of the curved member, and forms a step to be low forward in the wire advancing direction.

In a sixth invention, the curved member has a groove in a shape tapered along the wire advancing direction.

In a seventh invention, the intermediate member consists of a first member movable integrally with the first annular portion and provided rotatably, relatively to the first annular portion, and a second member for operating the link mechanism directly, being operating in the same direction as the moving direction of the first member, by the first member through a spring whether the first member moves in normal direction or reverse direction.

In an eighth invention, the wire feeder has a guide member piercing guide hole for guiding the wire into the guide groove, being inclined in the longitudinal direction in a plane parallel to the plane extending in the longitudinal direction to the width direction of the guide groove of the head, at the outlet side of a pair of grooved gears for pinching and sending out the wire.

In a ninth invention, the motor is operated by a direct-current power source, and is limited in the torque so that its current may be lower than a preset value.

According to the first invention, which comprises a main body, and a loop forming unit having a pair of curved members with grooves disposed at the leading end of the main body so as to be free to open and close, the main body comprises a wire feeder for forming a loop of wire by feeding a wire into the grooves of the pair of curved members in a closed state so as to enclose the intersection of reinforcing bars, and a driving mechanism incorporating a motor for opening or closing the pair of curved members, and, after forming the loop, advancing and retracting the cutter for cutting off the wire being sent out to the grooves, twisting the formed loop, and advancing, retracting and rotating a pair of pin members disposed at an interval for binding the reinforcing bar by the wire, sequentially.

Therefore, since the driving mechanism is driven by one motor, the structure is simple and lightweight, and the working efficiency of reinforcing bar binding is enhanced.

According to the second invention, the pair of curved members are formed so as to operate by a link mechanism, and the driving mechanism comprises a first male thread member driven and rotated by the motor, a second male thread member disposed parallel to the first male thread member, driven and rotated by the motor through this first male thread member, a first annular portion having a female thread portion to be engaged with the first male thread member, and plural protrusions extending in the axial direction on the outer circumference for moving in the direction departing from the loop forming unit, that is, backward, when the first male thread member rotates normally, relatively to the female thread portion, being coupled to the link mechanism through an intermediate member, for closing the curved members by moving backward, and opening the curved members by moving forward in the direction toward the loop forming unit, a second annular portion having a female thread portion to be engaged with the second male thread member, and plural protrusions extending in the axial direction on the outer circumference for moving forward when the second male thread member rotates relatively along with the normal rotation of the first male thread member, being formed to be free to advance and retract integrally with the cutter and pin members, and to rotate integrally, for advancing the cutter by moving forward to move over the wire cutting position, and projecting the pin members to the position for twisting the loop, a pair of first pawl members to be engaged and disengaged with the protrusions of the first annular portion, for restraining the normal rotation of the first annular portion and allowing to move in a direction along the shaft in a first state which is an initial state before start of reinforcing bar binding work, moving from the position in the first state, hitting against the rear stopper, allowing to move in a forward direction toward the first annular portion restrained of the move in the backward direction, restraining reverse rotation and allowing normal rotation in a second state, and holding the second in third and fourth states, and a fifth state returning to the first state, a pair of second pawl members to be engaged and disengaged with the protrusions of the second annular portion, for restraining the rotation of the second annular portion and allowing to move in an axial direction in the first, second and third states, and allowing rotation of the second male thread member along the normal rotation of the first male member and rotation of the second annular portion in the same direction, restraining the rotation of the second annular portion in the opposite direction thereof, hitting against the front stopper after moving from the position in the third state, and allowing to move in the backward direction toward the second annular portion restrained of the move in the forward direction in the fourth and fifth states, and a head unit having a guide unit for sliding the cutter and pin members, and also having a guide groove for guiding the wire toward the inlet of the loop forming unit on the front surface, being provided rotatably. together with the pin members, wherein normal rotation of the first male thread member from the first state in which the first annular portion is at the advanced position and the second annular portion is at the retracted position causes to change to the second and third states, further normal rotation of the first male thread member to the fourth state, further normal rotation of the first male thread member to the fifth state, and the subsequent reverse rotation of the male thread member causes to move to the first state.

Therefore, in addition to the effects of the first invention, when twisting the loop, since the loop is twisted by applying a pulling direction at both sides by the pair of pin members, the height of the twisted portion of the loop is low. Besides, since the cutter is moved beyond the cutting position, when the head is rotated for twisting the loop, the cut portion of the wire is prevented from projecting out of the twisted portion of the loop as being bent by the friction with the peripheral inner wall of the head. As a result, when the reinforcing bar is buried in the concrete, the wire is prevented from being exposed from the concrete, and corrosion of the reinforcing bar can be suppressed.

According to the third invention, the guide groove of the head unit has an overhang portion projecting above the groove, at the outlet unit and at the advanced side when the head rotates for twisting the loop, and is inclined forward along the wire advancing direction.

Therefore, in addition to the effects of the above inventions, the wire is not dislocated from the guide groove when forming a loop, and the working efficiency is further enhanced.

According to the fourth invention, the front part of the head unit is formed as a slope so that the side wall of the guide groove may be lower toward the end portion, in the inlet side and outside side follower side portions when the head rotates for twisting the loop.

Therefore, in addition to the effects of the above inventions, the loop can be twisted smoothly as the loop is dislocated from the guide groove when twisting the loop.

According to the fifth invention, the loop forming unit comprises a stationary guide member having a guide surface which is inclined in the same direction as the bottom of the inlet of the groove at the inlet side of the groove of the curved member, and forms a step to be low forward in the wire advancing direction.

Therefore, in addition to the effects of the above inventions, the wire advances easily when forming a loop, the loop is formed smoothly, the wire feeding force can be reduced, and the working efficiency is enhanced, and the device is reduced in size.

According to the sixth invention, the curved member has a groove in a shape tapered along the wire advancing direction.

Therefore, in addition to the effects of the above inventions, the wire can be securely guided into the forward groove when forming a loop, and the reliability of loop forming can be enhanced.

According to the seventh invention, the intermediate member consists of a first member movable integrally with the first annular portion and provided rotatably, relatively to the first annular portion, and a second member for operating the link mechanism directly, being operating in the same direction as the moving direction of the first member, by the first member through a spring whether the first member moves in normal direction or reverse direction.

Therefore, in addition to the effects of the above inventions, when the curved members are closed, if, for example, the worker has his hand pinched by the curved members by mistake, the spring works as the cushion to prevent injury, or if the reinforcing bar is caught in the curved members, the spring works as the cushion to prevent the motor or driving unit from being overloaded. Still more, since the spring is provided, if the curved members are closed, there is a certain play allowing the curved members to move in the opening direction, and when the wire advanced in the grooves of the curved members, a clearance is formed between the wire and the groove bottom, which helps to form a loop, thereby contributing further to the enhancement of working efficiency and reduction of size of the driving unit. Further, when the curved members are opened, if the curved members hit against obstacle such as reinforcing bar to block the opening action of the curved members, the cutter and pin members operate to return to the initial state, and when the obstacle is cleared, the curved members can be also opened, so that the motor is prevented from being overloaded, too.

According to the eighth invention, the wire feeder has a guide member piercing guide hole for guiding the wire into the guide groove, being inclined in the longitudinal direction in a plane parallel to the plane extending in the longitudinal direction to the width direction of the guide groove of the head, at the outlet side of a pair of grooved gears for pinching and sending out the wire.

Therefore, in addition to the effects of the above inventions, the loop can be formed further smoothly.

According to the ninth invention, the motor is operated by a direct-current power source, and is limited in the torque so that its current may be lower than a preset value.

Therefore, in addition to the effects of the above inventions, the torque caused by the motor is prevented from becoming excessive to avoid excessive twisting of the loop, while the twisting degree can be kept constant.

BEST MODE FOR CARRYING OUT THE INVENTION

Figure 1:
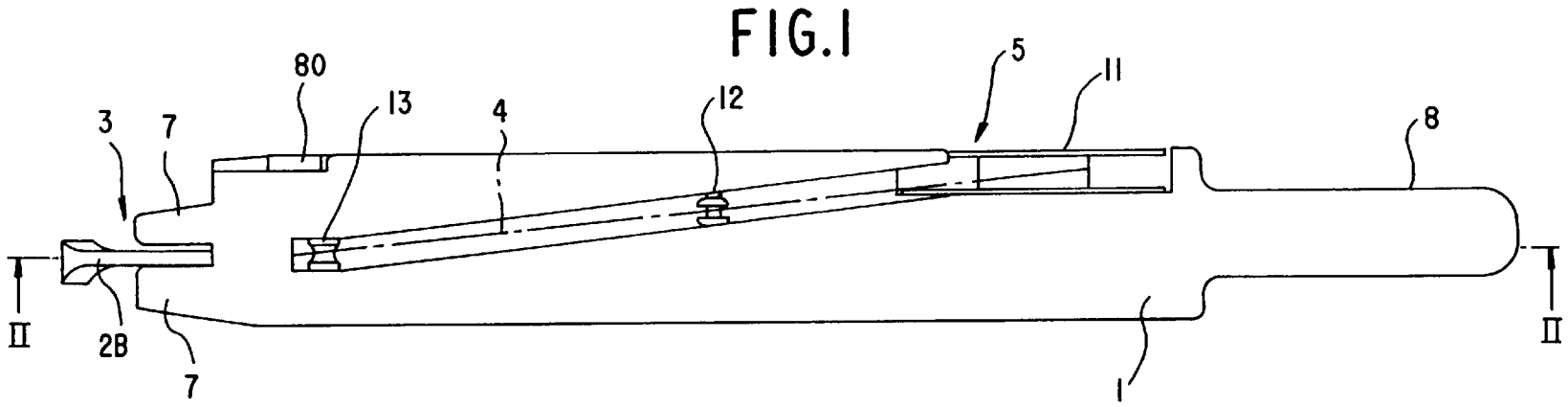
FIG. 1 is a plan view showing a first state of a reinforcing bar binding device according to the invention.

Referring now to the drawings, preferred embodiments of the invention are described in detail below.

Figure 2:
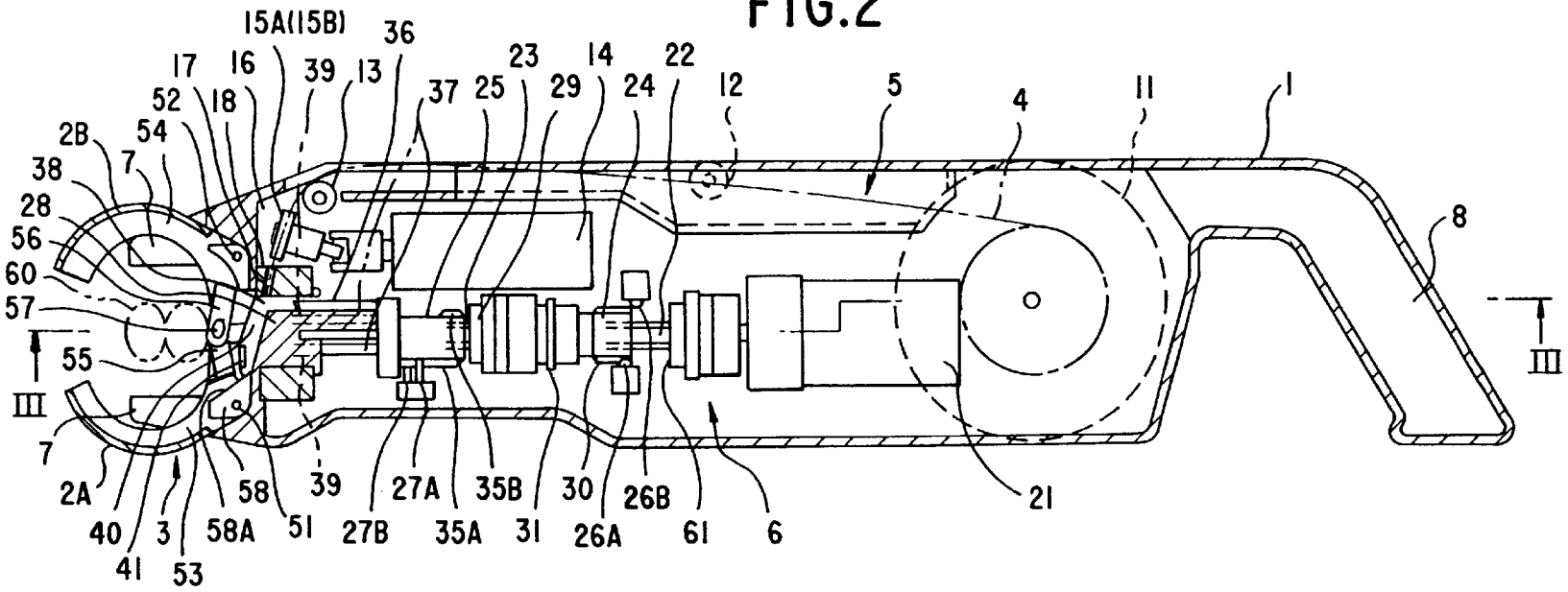
FIG. 2 is a sectional view of line II—II in FIG. 1.
Figure 3:
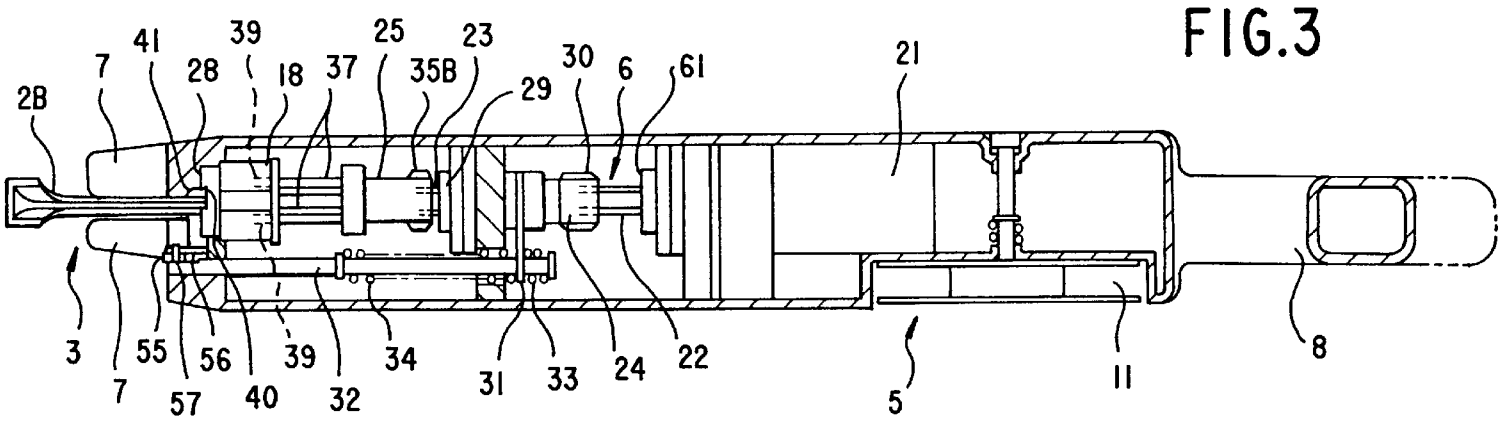
FIG. 3 is a sectional view of line III—III in FIG.

FIGS. 1 to 3 show the reinforcing bar binding device according to the invention, which is composed of a main body 1, and a loop forming unit 3 having a pair of grooved curved members 2A, 2B provided at the leading end of the main body 1 in a manner free to open and close.

The main body 1 comprises a wire feeder 5 for feeding a wire 5 to the loop forming unit 3, and a driving mechanism 6 for cutting the wire 4, opening and closing the curved members, and twisting the wire loop as specifically described below. In the front portion of the main body 1, that is, at the left end in FIG. 2, a total of four protrusions 7 are provided at both sides of the curved members 2A, 2B, and a handle 8 is formed in the rear portion of the main body 1. The protrusions 7 function to position the intersection of reinforcing bars at the center of twisting, and also function to prevent the curved members 2A, 2B from abutting against the reinforcing bar or other object and being broken.

The wire feeder 5 consists of a wire reel 11 on which the wire 4 is wound, grooved guide rollers 12 provided rotatably, a wire pay-off unit 16 having a pair of grooved gears 15A, 15B driven by a first motor 14, and a fixed annular guide member 18 having a guide hole 17 for inclining and guiding the wire 4.

In this specification, the motor or the combination of the motor and reduction gear is expressed as the motor.

The driving mechanism 6 comprises a second motor 21, a first male thread member 22, a second male thread member 23, a first annular portion 24, a second annular portion 25, a pair of first pawl members 26A, 26B, a pair of second pawl members 27A, 27B, and head 28. The first male thread member 22 is driven by the second motor 21, and is rotated both normally and reversely. The second male thread member 23 is disposed parallel to the first male thread member 22, and is coupled through a reduction gear and is rotated in the same directions s the first male thread member 22.

The first annular portion 24 has plural protrusions 30 extending in the axial direction on the outer circumference, having a female thread portion to be engaged with the first male thread member 22, for moving to the right in FIG. 2, or backward, when the first male thread member 22 normally rotates, relatively to the female thread portion. The first annular portion 24 has a plate 31, which does not rotate if the first male thread member 22 and first annular portion 24 rotate but moves in the axial direction together with the first annular portion 24, through a proper bearing. Penetrating through this plate 31, a bar member 32 is provided parallel to the first and second male thread members 22, 23, and the bar member 32 is moved in the axial direction by the plate 31 through coil springs 33, 34 disposed at both sides of the plate 31.

The second annular portion 25 has a female thread portion 43 (see FIGS. 16, 17; to be described later) engaged with the second male thread member 23, and when the second male thread member 23 rotates normally relatively to the female thread portion 43, it moves to the left in FIG. 2, or in the forward direction. On the outer circumference of the second annular portion 25, plural protrusions 35A, 35B are provided. At the forward end of the second annular member 25, a cutter 36 and two pin members 37 are projected.

The first pawl members 26A, 26B are arranged so as to be engaged with the protrusions 30 of the first male thread member 22 at different positions, and the leading ends are thrust by spring so as to always press the first pawl members 26A, 26B. The second pawl members 27A, 27B are also arranged so as to be engaged with the protrusions 35A, 35B of the second male thread member 23 at different positions, and the leading ends are thrust by spring so as to always press the second pawl members 27A, 27B.

The head 28 has a guide groove 38 for sliding the cutter 36, and a guide hole 39 for sliding the pin members 37, and is rotatably inserted into the fixed guide member 18. Together with the second annular portion 25, when the cutter 36 and pin members 37 rotate, the head 28 rotates together. In the middle of the end ahead of the head 28, a guide groove 40 is opened for guiding the wire 4 guided by the guide hole 17 into the loop forming unit 3 and further into the inlet of the curved member 2A. The bottom of the guide groove 40 is inclined, in FIG. 2, so that the lower side may be positioned forward rather than the upper side, and is formed so that the wire 4 may be inclined in the same direction as the inlet. At the outlet of the guide groove 40, and at the advancing side when the head 28 rotates for twisting the loop of the wire 4, an overhang portion 41 projecting over the groove is provided.

The loop forming unit 3 has the curved members 2A, 2B as mentioned above, and they are rotatably supported on the main body 1 by pins 51, 52. In the curved members 2A, 2B, grooves 53, 54 are formed in the shape tapered in the advancing direction of the wire 4, and in this illustrated example, when the curved members 2A, 2B are closed, the leading end of the curved member 2A gets into the groove 54 of the curved member 2B. As a result, between the groove 53 and groove 54, there is a step difference so that the advancing direction of the wire 4 is lower.

On the other hand, in the curved members 2A, 2B, link members 55, 56 for forming a link mechanism having a slot are fixed, and this slot is engaged with the bar member 32 through a pin 57. When the bar member 32 moves forward, that is, to the left in FIG. 2, the curved members 2A, 2B are opened to be in the state as shown in FIG. 2. To the contrary, when the bar member 32 moves backward, the curved members 2A, 2B are closed. Thus, between the bar member 32 and plate 31, coil springs 33, 34 are provided, and as the plate 31 moves forward or backward, the bar member 32 moves somewhat later. That is, when the spring force by the coil spring 33 or coil spring 34 becomes somewhat large, the bar member 32 begins to move. Therefore, when the plate 31 moves, the curved members 2A, 2B are not opened or closed immediately, but are moved somewhat later.

For example, in the closed state of the curved members 2A, 2B, when a force in the opening direction acts on the curved members 2A, 2B, until the spring force by the coil spring 33 becomes somewhat large, the curved members 2A, 2B are movable in the opening direction, that is, although the plate 31 and curved members 2A, 23 are coupled indirectly, they are not coupled rigidly, but are coupled with a slight play between them. This play helps to advance the wire 4 smoothly.

In the absence of the coil spring 33, when the curved members 2A, 2B are closed, smooth operation is not realized unless the precision of position and dimensions of the curved members 2A, 2B, slots in the link members 55, 56, bar member 32, and first annular portion 24 is sufficiently high. In actual trial products, when closing the curved members 2A, 2B, the engagement portions of the link members 55, 56 and bar member 32 are stopped after moving 12 mm, while the first annular portion 24 moves by 14 mm. Therefore, when the curved members 2A, 2B are closed, the coil spring 33 is contracted by 2 mm from the initial state, so that the error in the position and dimension of the members can be allowed.

This coil spring 33 also functions as a cushion, if the worker has his hand pinched by the both members by mistake, when closing the curved members 2A, 2B, and also functions to lessen the load acting on the motor or the like if the reinforcing bar is caught between the both members.

On the other hand, when the curved members 2A, 2B return from the closed state to open state, as mentioned later, the second motor 21 rotates reversely, the first annular portion 24 advances to move the bar member 32 forward, and at the same time the second annular portion 25 retracts to move the cutter 36 and pin members 37 backward. In this case, if the opening motion of the curved members 2A, 23 is blocked by, for example, reinforcing bar, since the coil spring 34 is provided, the cutter 36 and pin members 37 are allowed to retract.

In this case, the first annular portion 24 and second annular portion 25 return to the initial state described below, and the curved members 2A. 2S are in closed state or incompletely opened state, and hence the coil spring 34 is contracted from the initial state. By moving the reinforcing bar binding device and is pulled out of the disturbing reinforcing bar, the curved members 2A, 2B are opened by the force of the coil spring 34.

Further, at the inlet of the groove 53 of the curved member 2A, there is a stationary guide member 58 for guiding the wire 4 guided by the guide groove 40 into the groove 53. The guide surface 58A of this stationary guide member 58 is inclined, and forms a step difference to be lower in the forward direction when advancing from the guide surface 58A to the groove 53. This step difference and the step difference formed between the curved members 2A, 2B contribute to smoother advancing of the wire 4, and the stationary guide member 58 helps to curve the wire 4 initially at a greater curvature rate than the curvature rate of the curved member 2A.

Figure 4:
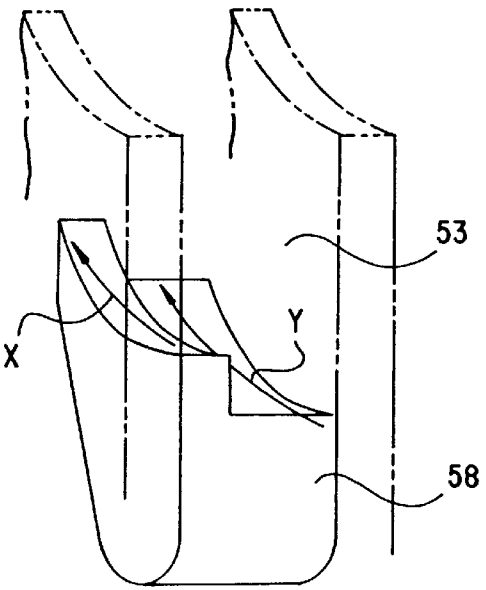
FIG. 4 is a perspective view showing an example of a stationary guide member shown in FIG. 2.

As shown in FIG. 4, meanwhile, the guide surface 58A of the stationary guide member 58 is preferred to be formed to have a step difference in its width direction. In this case, the wire 4 coming in with a slope to the plane including the guide groove 40 first advances into the upper stage of the left side of the guide surface 58A as indicated by arrow X in FIG. 4, and in the second turn, it advances to the lower stage at the right side of the guide surface 58A as indicated by arrow Y. That is, without overlapping, the wire 4 is sequentially deviated in the width direction of the guide groove 40, so that a loop is formed smoothly.

Figure 5:
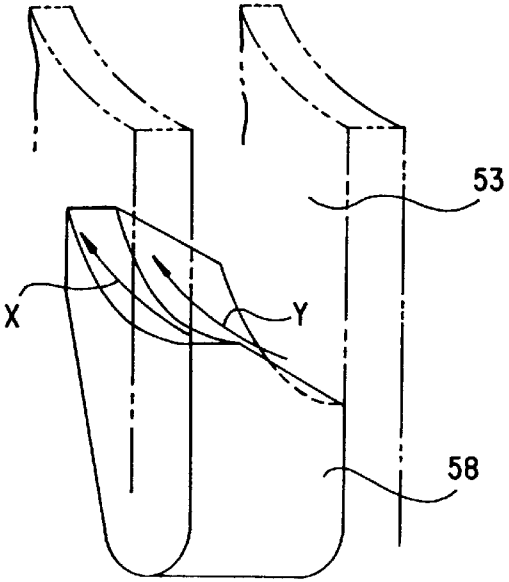
FIG. 5 is a perspective view showing other example of a stationary guide member shown in FIG. 2.

Moreover, as shown in FIG. 5, the guide surface 58A may be a slope. In this case, the wire 4 advances according to arrow X in the first turn, and according to arrow Y in the second turn.

In the case of the reinforcing bar binding device illustrated herein, the loop forming unit 3 has the stationary guide member 58, but this stationary guide member 58 is not always required, but instead of this stationary guide member 58, a guide member of a substantially same shape may be fixed in the curved member 2A so as to operate integrally with the curved member 2A.

The motors in the reinforcing bar binding device are driven, for example, by batteries not shown herein. Therefore, the first and second motors 14, 21 are DC motors.

In the illustrated example, moreover, the upper limit of the current flowing in the second motor 21 is determined and it is designed so that larger current may not flow. In the case of a DC motor, the flowing current and the torque produced by the DC motor are proportional. Therefore, when the upper limit of the current is determined, the DC motor stops when reaching a specific torque, that is, a torque to such an extent as not to twist the loop too much. When the second motor 21 stops, this stop of rotation is detected by a sensor, not shown, and reverse rotation is started.

Preferably, this upper limit should be adjustable because the optimum torque for twisting varies with the diameter of reinforcing bar and operating conditions of the reinforcing bar binding device.

Together with the operation of the reinforcing bar binding device, its structure is specifically described below.

The reinforcing bar binding device shown in FIGS. 1 to 3 shows the first state or the initial state, and the leading end of the wire 4 is positioned at the outlet of the guide hole 17, the first annular portion 24 is positioned to the left in FIG. 2, the second annular portion 25 is positioned to the right, and the curved members 2A, 2B are opened. The protrusion 30 of the first annular portion 24 is engaged with the first pawl member 26A, and normal rotation of the first annular portion 24 is defined, and the protrusion 35A of the second annular portion 25 is engaged with the second pawl members 27A, 27B, and the rotation of the second annular portion 25 is defined.

In the first state, the loop forming unit 3 is positioned so as to surround the intersection of the reinforcing bar 60. In this case, as mentioned above, it is easy to position the intersection of the reinforcing bar 60 at the center of twisting, by means of the protrusion 7.

Figure 6:
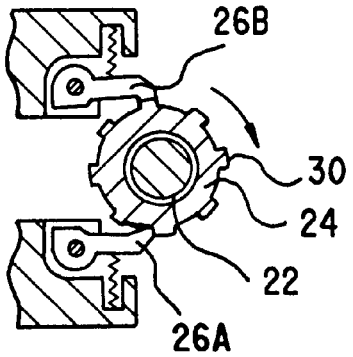
FIG. 6 is a partial sectional view showing an example of engaged state of a first annular member and a first pawl member.
Figure 7:
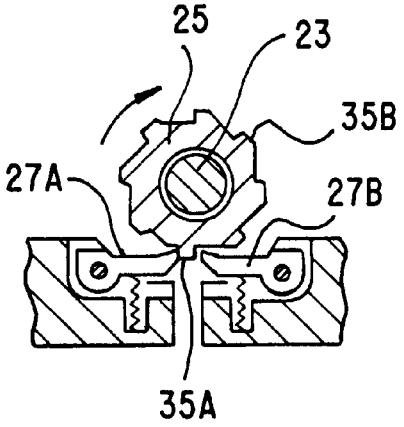
FIG. 7 is a partial sectional view showing an example of engaged state of a second annular member and a second pawl member.

FIGS. 6, 7 show detail of the first and second annular portions 24, 25, first and second pawl members 26A, 26B, and 27A, 27B. The first pawl member 26A is engaged with the protrusion 30 to define only the normal rotation of the first annular portion 24, and the first pawl member 26B is engaged with the protrusion 30 to define only the reverse rotation of the first annular portion 24. In FIGS. 6, 7, the normal rotation is clockwise rotation as indicated by arrow. In the first state, the first pawl member 26B and the protrusion 30 are apart. The second pawl member 27B is engaged with the protrusion 35A or protrusion 35B to define the reverse rotation of the second annular portion 25, and the second pawl member 27A is engaged with the protrusion 35A to define the normal rotation of the second annular portion 25. In the first state, the second pawl members 27A, 27B are engaged with the protrusion 35A.

The protrusion 30 and protrusion 35B are shorter than the moving stroke of the first and second annular portions 24, 25, while the protrusion 35A is at least same in length as the moving stroke of the second annular portion 25.

Figure 8:
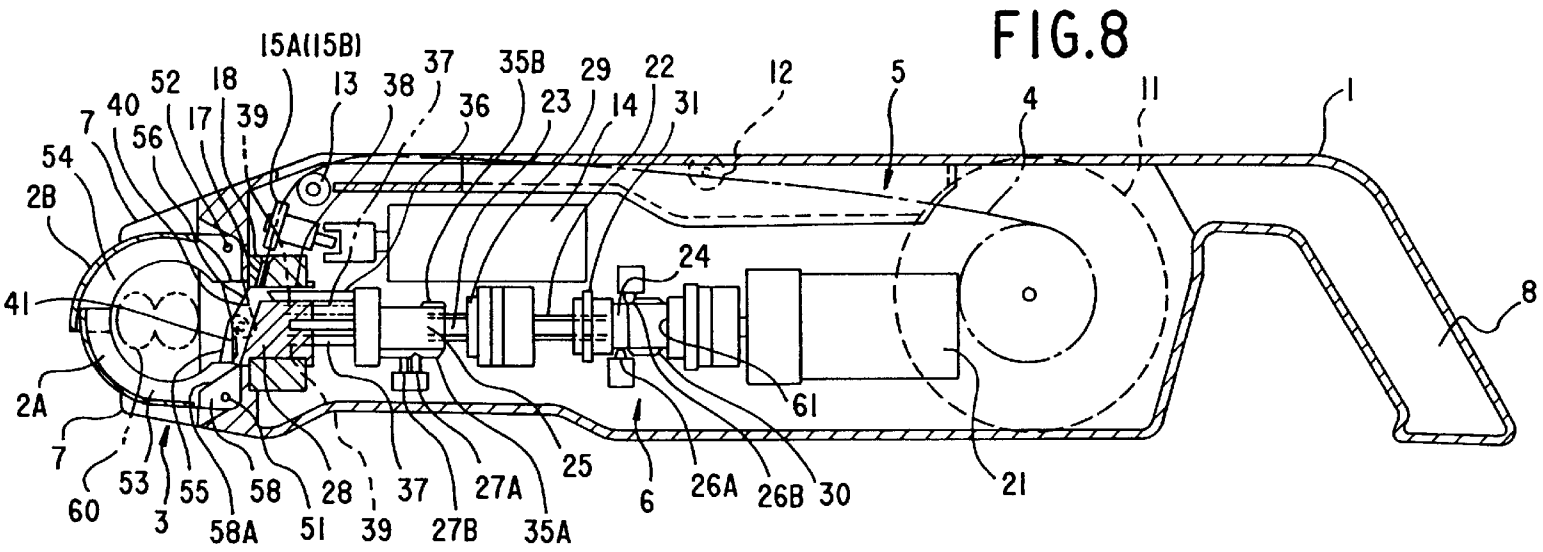
FIG. 8 is a diagram showing a second state of the reinforcing bar binding device of the invention, at a section of same position as in FIG. 2.
Figure 9:
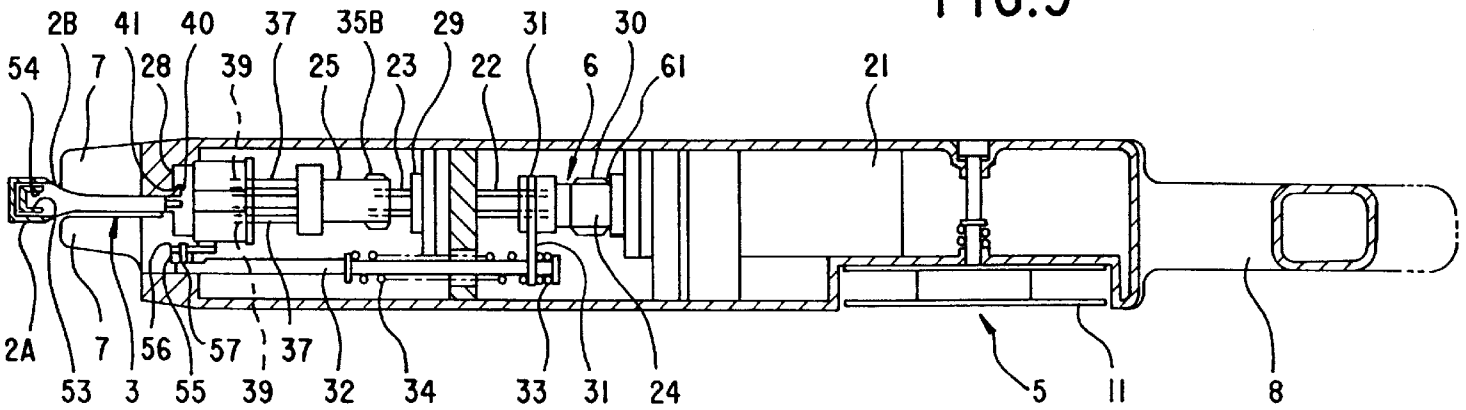
FIG. 9 is a diagram showing a second state of the reinforcing bar binding device of the invention, at a section of same position as in FIG. 3.

FIGS. 8 and 9 show the second state of the reinforcing bar binding device. In this state, the first male thread member 22 is rotated normally by the second motor 21, and the first annular portion 24 defined of normal rotation by the first pawl member 26A moves backward toward the rear stopper 61. Further, as the first annular portion 24 moves backward, the plate 31 moves backward, and, at the same time, the bar member 32 moves backward together with the plate 31. Consequently, through the pin 57, the leading ends of the link members 55, 56 engaged with the bar member 32 are attracted backward, and when the bar member 32 reaches the position where the curved members 2A, 2B are closed, the arrival of the bar member 32 is detected by the sensor not shown, so that the second motor 21 is stopped.

As a result of the first annular member 24 moving backward, the engagement of the first pawl member 26A and protrusion 30 is cleared, and the first pawl member 26B and protrusion 30 are engaged with each other. Hence, the first annular portion 24 is allowed to rotate normally, but is defined in the reverse rotation.

When the first male thread member 22 rotates normally, the second male thread member 23 also rotates normally at the same time, and the second annular portion 25 defined of normal rotation by the second pawl member 27B is moved forward. As the second annular portion 25 moves forward, the cutter 36 and pin member 37 also move forward.

Between the first male thread member 22 and second male thread member 23, a reduction gear 29 is placed, and the second male thread member 23 is rotated and driven at lower speed than the first male thread member 22. Therefore, when the curved members 2A, 2B are closed, the first male thread member 22 also moves together, and the closing force is weakened, so that the operator may not be injured if the hand is caught by mistake between the curved members 2A and 2B. That is, the driving tongue of the second motor 21 itself is small. Still more, by slowing down and rotating the second male thread member 23, the rotating torque of the second male thread member 23 is increased, so that a greater force may be generated when cutting the wire 4 by the cutter 36 or twisting the loop by the pin member 37 as mentioned below. Moreover, by slowing down and rotating the second male thread member 23, the forward moving amount of the cutter 36 and pin members 37 is prevented from being excessive.

Figure 10:
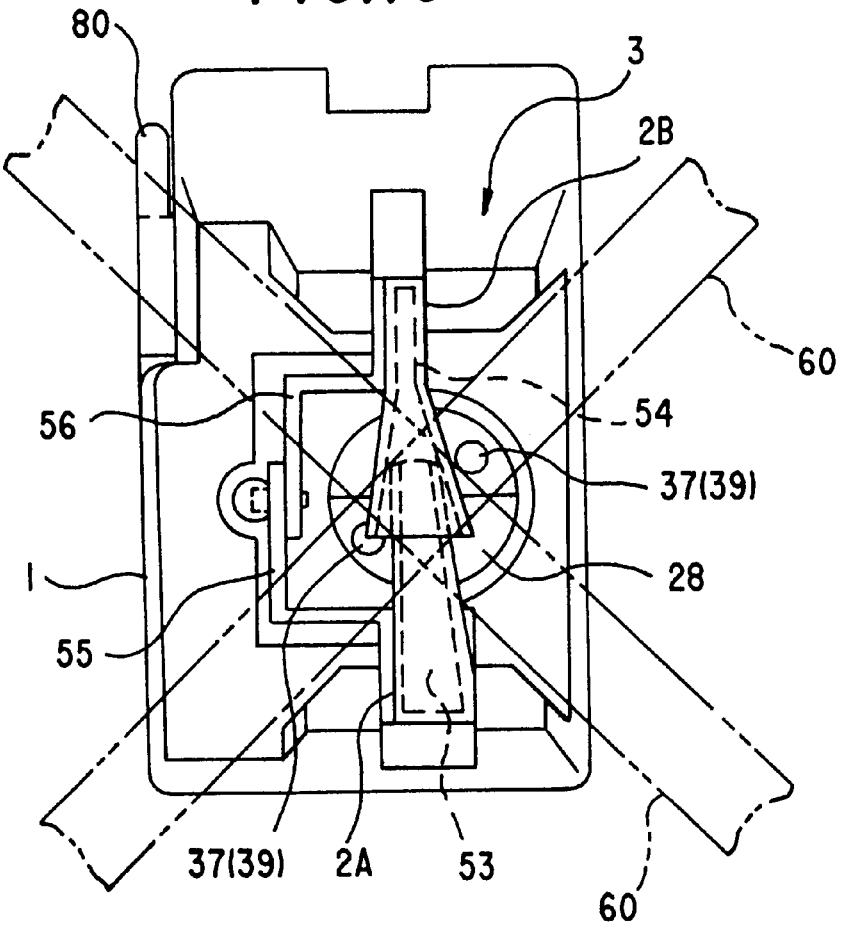
FIG. 10 is a left side view of second state of the reinforcing bar binding device of the invention.

FIG. 10 shows the reinforcing bar binding device in a closed state of the curved members 2A, 2B, in which the leading end of the curved member 2A gets into the inlet of the groove 54 of the curved member 2B, so that the wire 4 may advance smoothly from the groove 53 of the curved member 2A into the groove 54 of the curved member 2B.

Figure 11:
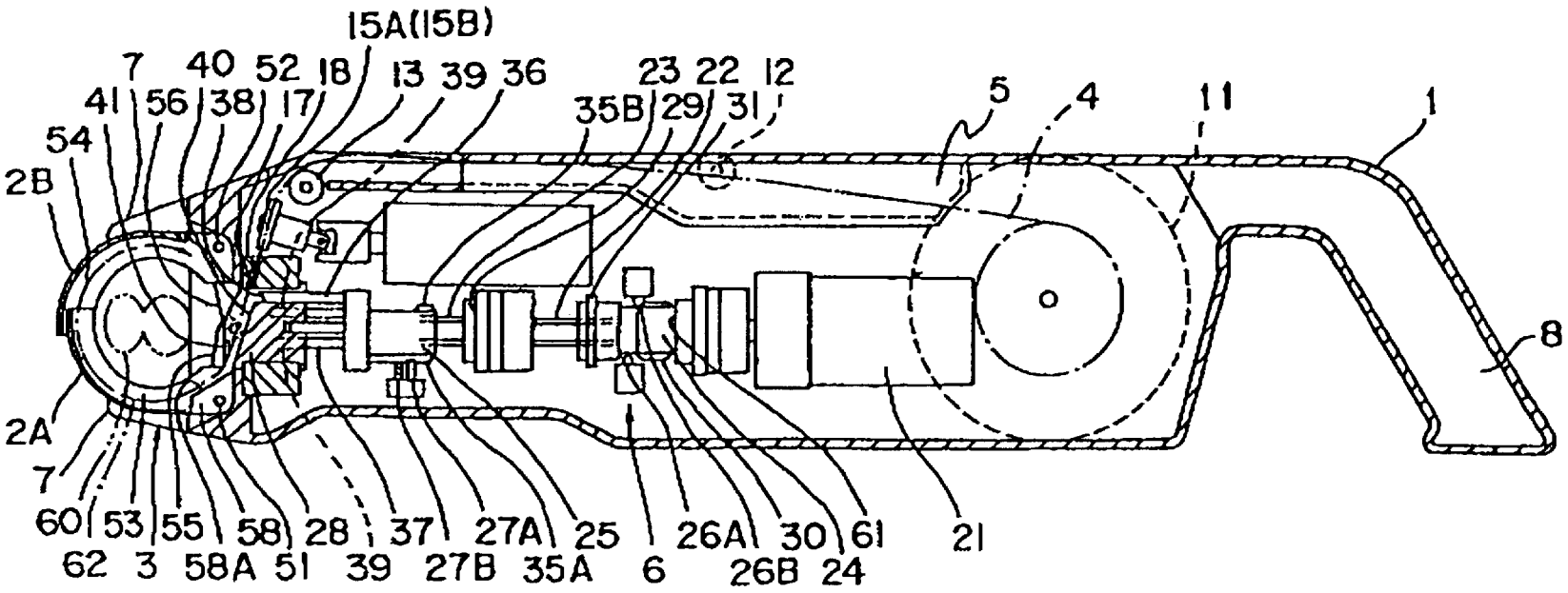
FIG. 11 is a diagram showing a third state of the reinforcing bar binding device of the invention, at a section of same position as in FIG. 2.

FIG. 11 shows a third state of the reinforcing bar binding device. In this state, the mutually engaged pair of gears 15A, 15B are rotated by the first motor 14, and the wire 4 is sent into the curved members 2A, 2B through the guide hole 17, guide groove 40, and stationary guide member 58. Moreover, along the grooves 53, 54 of the curved members 2A, 2B, the wire 4 is wound plural times, for example, 2.5 times or 3 times, and the wire loop 62 is formed. The number of revolutions of the first motor 14 is detected by a sensor not shown, and the first motor 14 stops automatically after operating for the specified number of revolutions.

Figure 12:
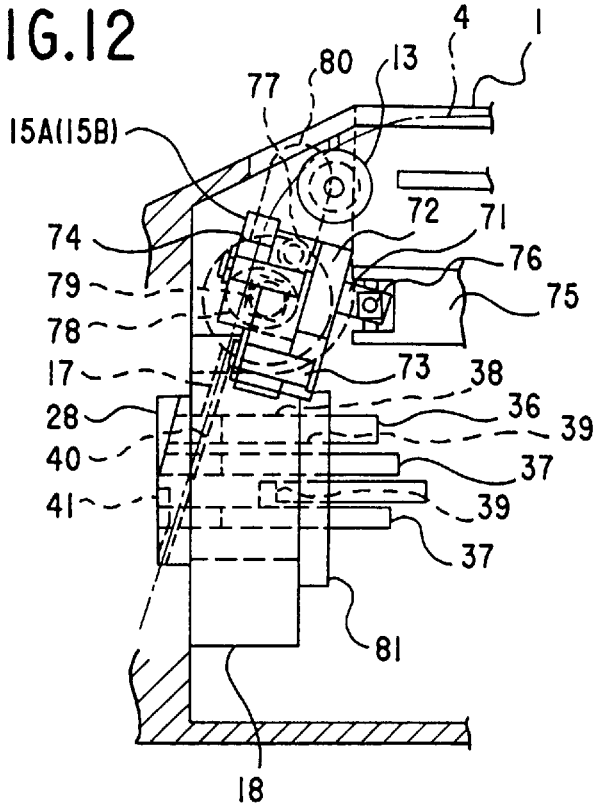
FIG. 12 is a partial sectional view showing essential parts of a wire feeding mechanism of the reinforcing bar binding device shown in FIG. 11.
Figure 13:
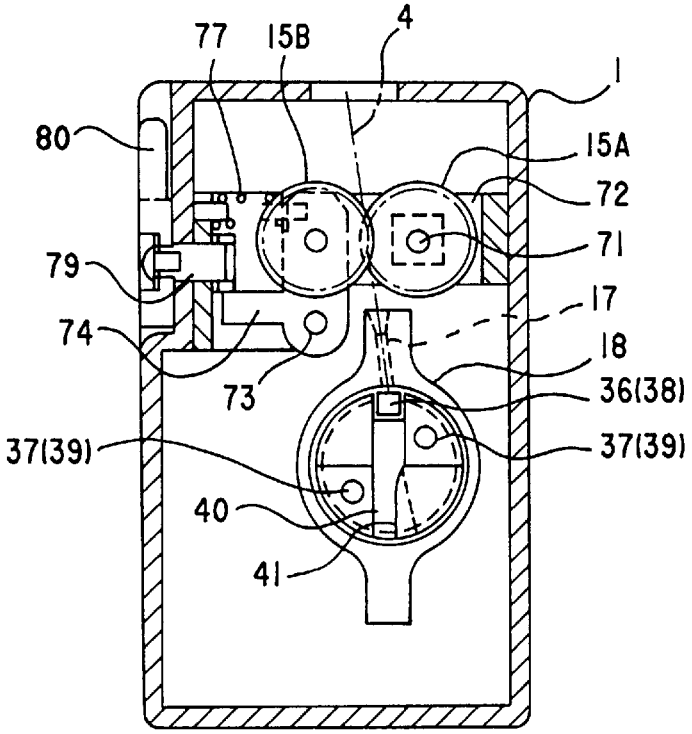
FIG. 13 is a partial sectional view showing a state of the wire feeding mechanism shown in FIG. 12, seen from a forward direction, by omitting the wall portion of the main body.

As shown in FIGS. 12 and 13, the gear 15A is rotatably supported on a support plate 72 by a shaft 71, and the gear 15B is rotatably supported on an L-shaped support member 74 rotatably supported by a pin 73. The shaft 71 rotatably penetrates through the support plate 72, and is coupled with a drive shaft 75 rotated by the first motor 14 through a universal joint 76. Directly, the gear 15A is driven by the first motor 14, and the gear 15B is engaged with the gear 15A so as to rotate synchronously with the gear 15A. The gears 15A, 15B have, for example, V-section grooves in the central part.

In FIG. 13, the upper part of the support member 74 is always thrust toward the gear 15A by a coil spring 77 supported on the inner wall of the main body 1 at one end portion. That is, the gear 15B is thrust so as to be engaged always with the gear 15A.

In FIG. 13, a cam 78 is engaged with the end portion beneath the support member 74. The cam 78 is rotatable about a shaft 79 penetrating through the wall of the main body 1. At the outside of the main body 1, the shaft 79 is provided with a handle 80 to rotate integrally therewith. FIGS. 12 and 13 show the state in which the shorter end of the cam 78 is engaged with the lower end of the support member 74, and the end portion is raised by the force of the coil spring 77. In this case, the gears 15A, 15B are kept in engaged state.

On the other hand, from the state shown in FIGS. 12, 13, rotating the handle 80, the longer end of the cam 78 is engaged with the end portion, and the end portion moves down, overcoming the force of the coil spring 77, and the support member 74 rotates in the counterclockwise direction in FIG. 13. As a result, the gear 15BV moves in a direction departing from the gear 15A, and the passage for the wire 4 formed by the grooves of the gears 15A, 15B is widened. Therefore, for example, by replacing the wire reel 11, when passing a new wire 4 into the gears 15A, 15B, by departing the gears 15A, 15B by the handle 80 as mentioned above, the wire 4 may b easily guided in between the gears 15A, 15B.

When departing the gears 15A, 15B by the handle 80, if the engagement of the gears 15A, 15B is completely eliminated, the both are not always engaged completely when the gear 15B is pressed again to the gear 15A, and it is preferred to leave the engagement slightly.

Besides, in order that the wire 4 may smoothly advance into the guide hole 17 by the gears 15A, 15B, it is sent out in a state inclined when seen from either sideward or forward direction of the reinforcing bar binding device as shown in FIGS. 12 and 13.

In particular, as shown in FIG. 13, the wire 4 advances in an oblique direction to the guide groove 40, and gets into the stationary guide member 58 through the right side in FIG. 13 at the outlet of the guide groove 40.

In this right side portion, the overhang portion 41 is formed, and this overhang portion 41 prevents the wire from being dislocated from the guide groove 40 effectively.

Figure 14:
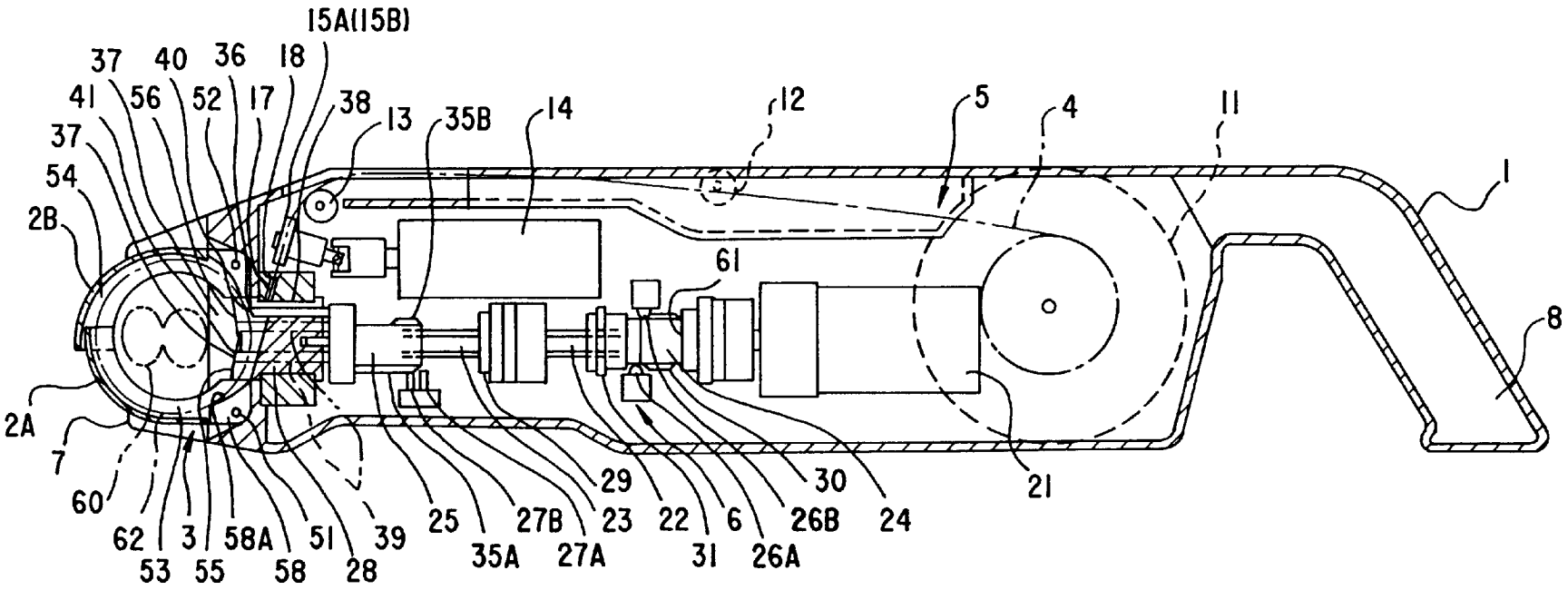
FIG. 14 is a diagram showing third and fourth states of the reinforcing bar binding device according to the invention, at a section of same position as in FIG. 2.
Figure 15:
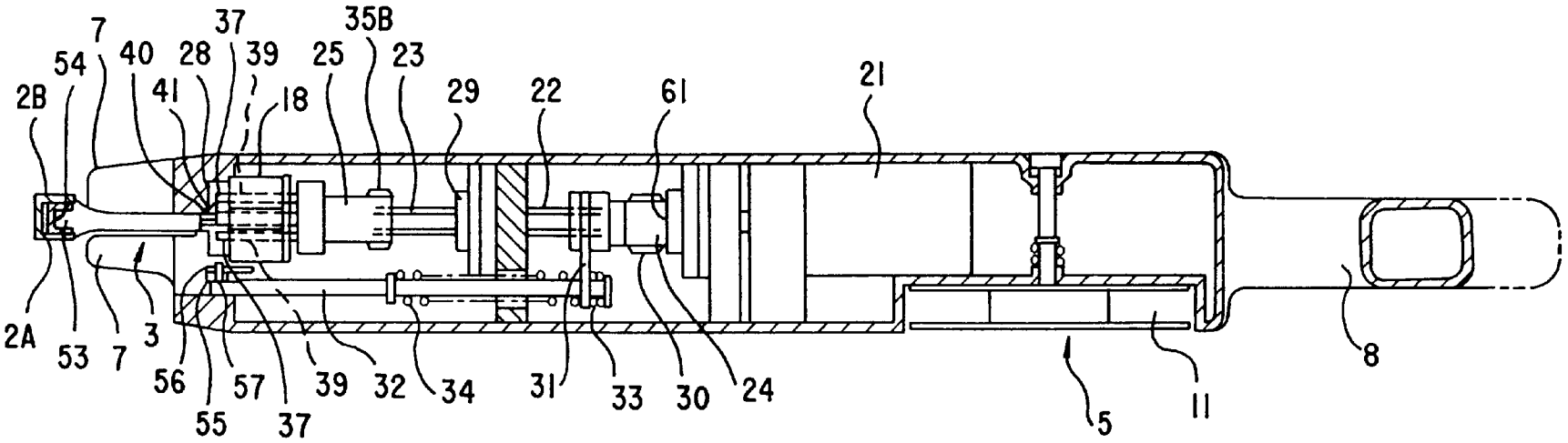
FIG. 15 is a diagram showing third and fourth states of the reinforcing bar binding device according to the invention, at a section of same position as in FIG. 3.

FIGS. 14 and 15 show the fourth and fifth states of the reinforcing bar binding device. First, in the fourth state, further by the second motor 21, the second male thread member 23, together with the first male thread member 22, begins to rotate normally, and the first annular portion 24 rotates normally at the same position, while the second annular portion 25 is defined of the normal rotation by the second pawl member 27A, and moves forward together with the cutter 36 and pin members 37. As the cutter 36 moves forward, the wire 4 is cut off at the outlet of the guide hole 17, and the pin members 37 project from the front side of the head 28. As described above, the second male thread member 23 slows down and rotates, so that the cutter 36 advancing force may be greater when cutting off the wire 4. Moreover, the cutter 36 not only cuts off the wire 4, but also advances to the position of pushing out the cut portion of the wire 4 at the head 28 side to the front side of the head 28 (see FIG. 17). This point is further described below.

Figure 16:
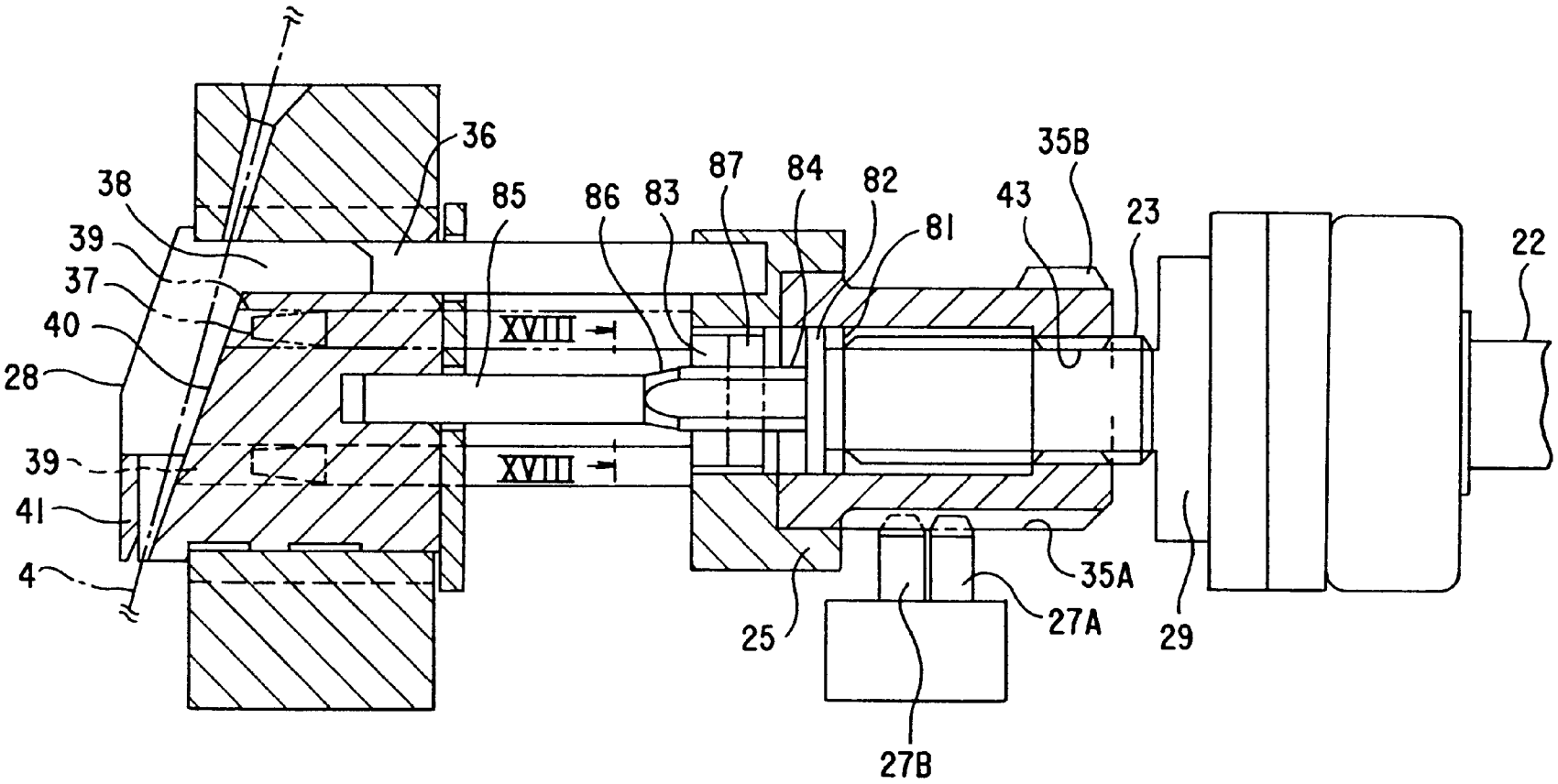
FIG. 16 is a partial sectional view showing a second male thread member, a second annular portion, a head, and its vicinity, in the second state of the reinforcing bar binding device according to the invention.

When the pin members 37 project to the front side of the head 28, and the cutter 36 advances to the above position, as shown in FIG. 16, the second annular portion 25 abuts against a front stopper 81 provided in the second male thread member 23, and stops advancing. As the second male thread member 23 slows down and rotates, the forward speed of the pin member 37 is reduced, so that the advancing amount may not be excessive. When the second annular portion 25 hits against the front stopper 81, the second pawl member 27A and the protrusion 35A depart from each other, and the second annular portion 25 is put in normal rotation.

Incidentally, as shown in FIG. 16, a flange member 82 is provided around the front end of the male thread portion of the second male thread member 23.

On the other hand, the second annular portion 25 has a space 83 for inserting this flange member 82 in its inside, and the female thread portion 43 is provided in the rear side opening of this space 83, and its inside diameter is smaller than the outside diameter of the flange member 82. The end portion of the female thread portion 43 side of the flange member 82 is the front stopper 81.

Figure 17:
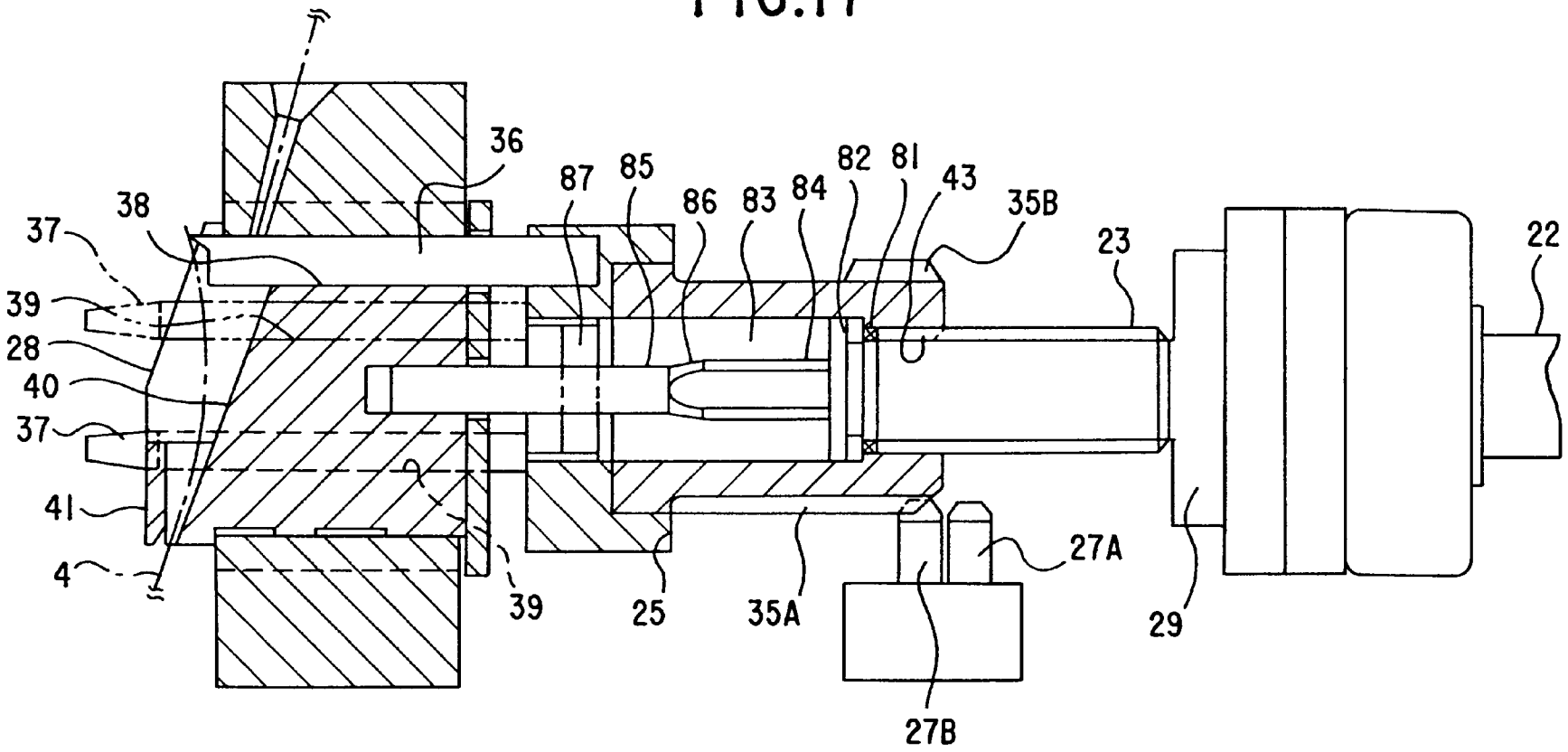
FIG. 17 is a partial sectional view showing the second male thread member, the second annular portion, the head, and its vicinity, in the third and fourth states of the reinforcing bar binding device according to the invention.
Figure 18:
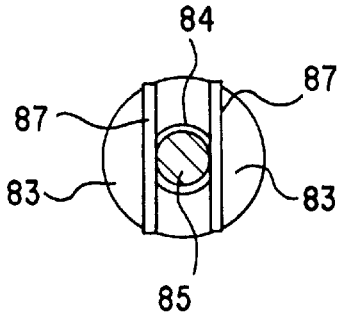
FIG. 18 is a partial sectional view of line XVIII—XVIII in FIG. 16.
Figure 19:
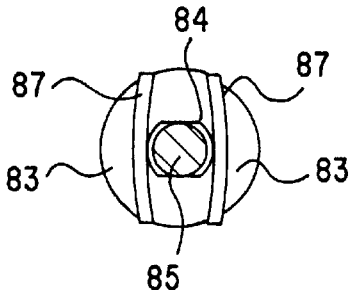
FIG. 19 is a partial sectional view showing other state at same position as in FIG. 18.

At the forward side of the flange member 82, the bar upper member is projecting, and its base part 84 has a section in a shape cutting parallel the both sides of the circular shape, and a front end portion 85 has a section in a circular shape of smaller diameter than the above circular shape, and the base part 84 is continuous to the end portion 85 through a taper 86. On the other hand, in the inner wall near the opening of the space 83, two leaf springs 87 are disposed parallel across an interval. As shown in FIG. 16, in the third state in which the second annular portion 25 is at the retracted position, as shown in FIG. 18, the leaf spring 87 is kept in a state of pressing the flat portions at both ends of the base part 84 by a spring force. FIG. 19 shows a state of the leaf spring 87 being pushed widely by the arc portion of the base part 84, as only the second male thread member 23 is rotated, in the state where the base part 84 is engaged with the leaf spring 87. By contrast, as shown in FIG. 17, when the second annular portion 25 is advanced, the leaf spring 87 is departed from the base part 84, and is not engaged with a leading end 85 having a circular section. These states are described later.

In the fifth state, successively to the fourth state, the second motor 21 continues to rotate normally. In this case, the first annular portion 24 rotates normally at the same position, and the second annular portion rotates normally at the same position. At the same time, the pin members 37 rotate together with the head 28, and the loop 62 is twisted.

As mentioned above, the upper limit of the current flowing in the second motor 21 is specified, and when the torque by the second motor 21 reaches a predetermined value, the second motor 21 stops. When stopping of the rotation of the second motor 21 is detected by a sensor not shown, the second motor 21 begins to rotate reversely.

Since the second annular portion 25 is defined of its reverse rotation, and it begins to retract along the second male thread support member 23. When the second annular portion 24 retract to the predetermined position, the arrival at this position is detected by a sensor not shown, and the reverse rotation of the second motor 21 is terminated. That is, the reinforcing bar binding device returns to the first state.

The operation is further described by referring to FIGS. 20 to 28.

Figure 20:
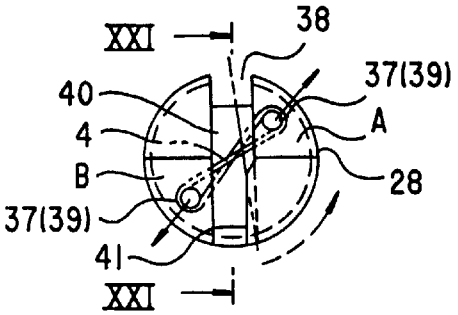
FIG. 20 is a diagram showing the head of the reinforcing bar binding device shown in FIG. 1.

FIG. 20 shows only the head 28 in FIG.13, and as indicated by twin dot chain line, the loop 62 is twisted in a state being pulled in the direction indicated by solid line arrow in the diagram by the pin members 37.

Figure 21:
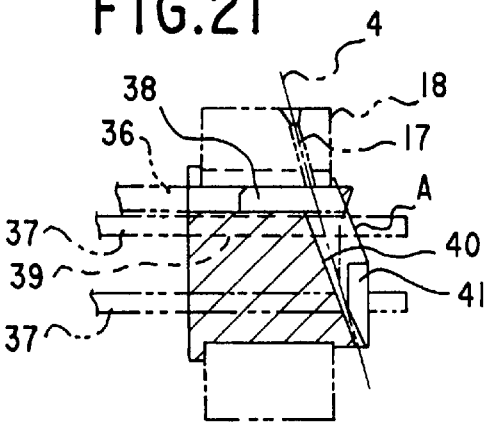
FIG. 21 is a sectional view of line XXI—XXI in FIG. 20.

As shown in FIG. 21, the cutter 36 cuts the wire 4, and advances until the end of the wire 4 at the head 28 side is positioned outside of the head 28.

On the other hand, the front side of the head 28 is formed as a slope so that the side wall of the guide wall 40 may be lower toward the end portion, in the follow-up side portion of the inlet and outlet of the guide groove 40, when the head 28 rotates normally as indicated by broken line arrow in FIG. 20, that is, when twisting the loop 62. More specifically, in FIGS. 20 to 24, the sector ends indicated by A and B are sloped so that the groove depth may be smaller toward the end portion of the guide groove 40.

Figure 22:
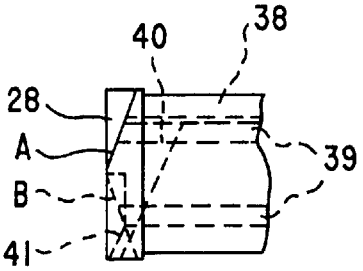
FIG. 22 is a side view of the head shown in FIG. 20.
Figure 23:
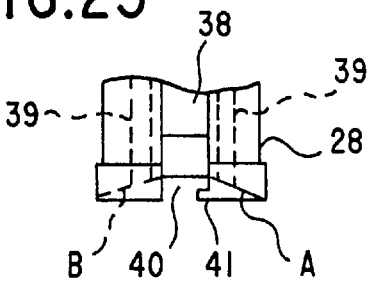
FIG. 23 is a top view of the head shown in FIG. 20.
Figure 24:
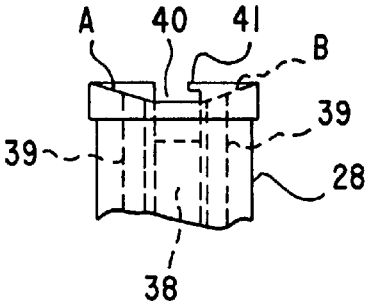
FIG. 24 is a bottom view of the head shown in FIG. 20.
Figure 25:
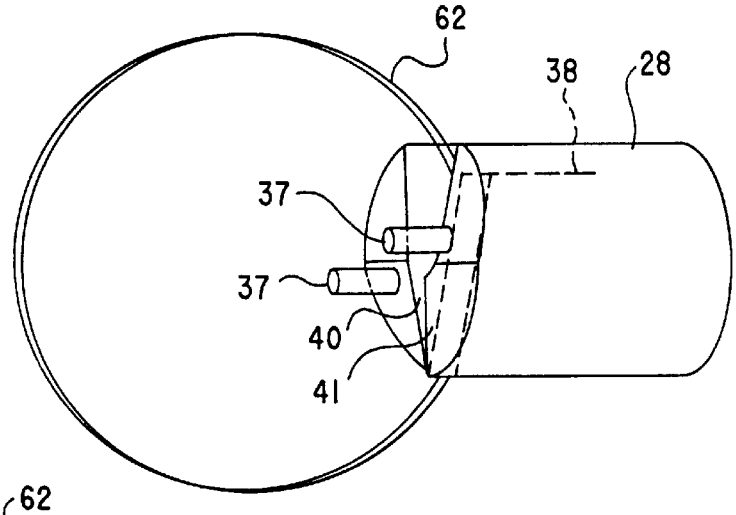
FIG. 25 is a schematic perspective view of the state before start of twisting of loop of wire by pin members projecting from the head shown in FIG. 20.
Figure 26:
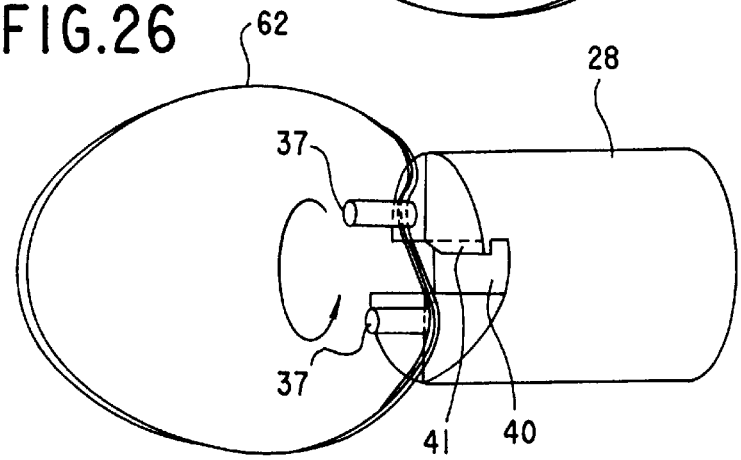
FIG. 26 is a schematic perspective view showing an intermediate state of twisting of loop of wire by pin members projecting from the head shown in FIG. 20.
Figure 28:
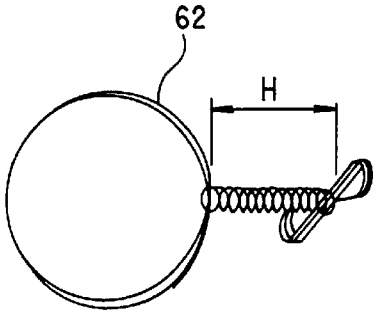
FIG. 28 is a perspective view showing the loop of wire twisted by pin members projecting from the head shown in FIG. 20.
Figure 27:
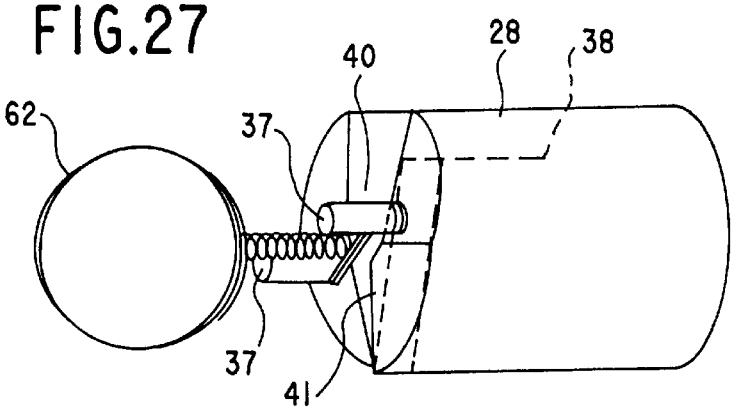
FIG. 27 is a schematic perspective view showing a completed state of twisting of loop of wire by pin members projecting from the head shown in FIG. 20.
Figure 29:
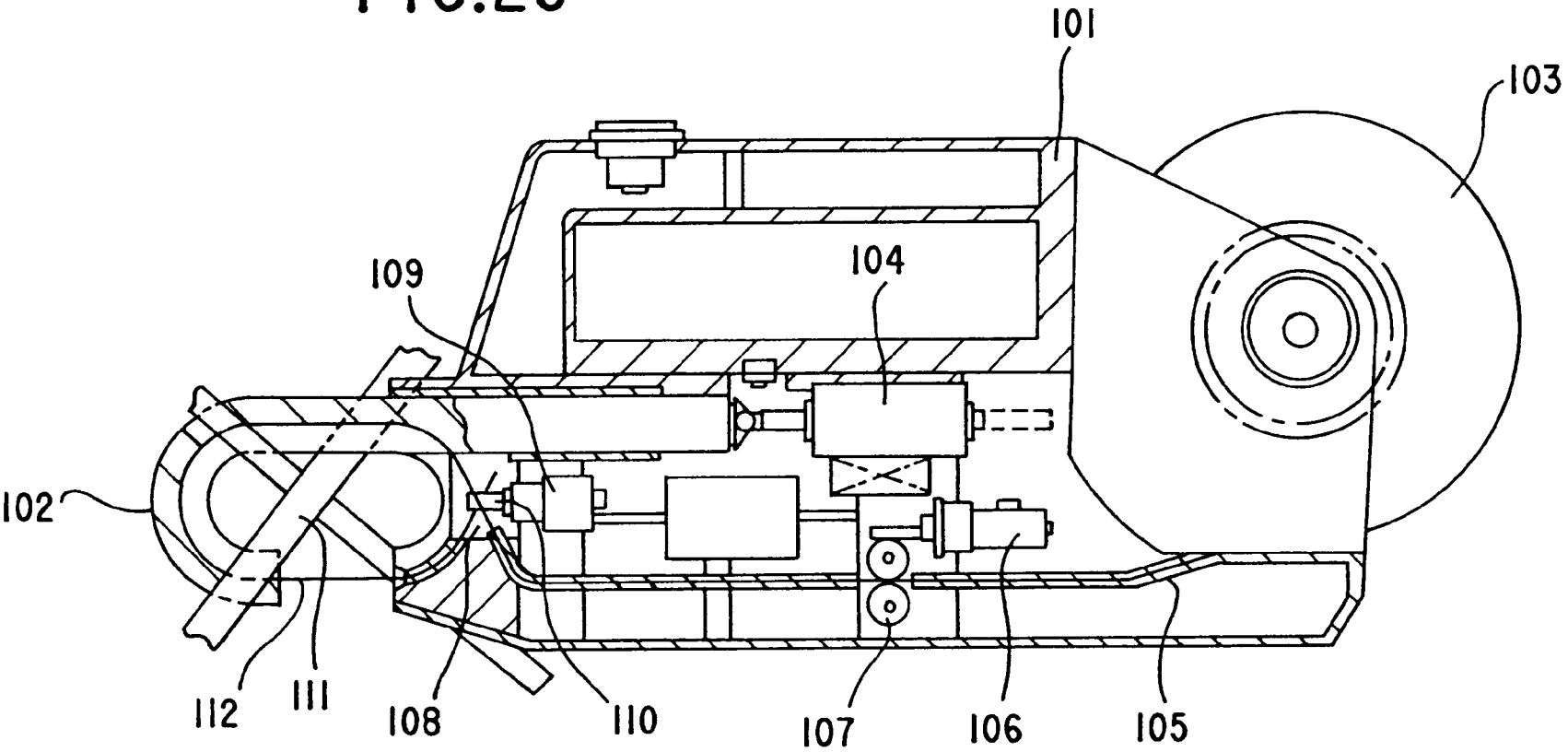
FIG. 29 is a sectional view showing a conventional reinforcing bar binding device.

Incidentally, FIGS. 22 to 24 show only the head 28, and the others are omitted, and FIGS. 25 to 28 are for clarifying the state of twisting of the loop 62, and other parts not directly relating with twisting are omitted.

The overhang portion 41 is opened at the follow-up side when rotating for twisting the loop 62, and when twisting is started, the loop 62 is immediately dislocated from the overhang unit 41. As mentioned above, moreover, since the end surfaces of the head 28 indicated by A and B are formed in slopes, the loop 62 is dislocated from the guide groove 40 immediately when twisting is started. Further, as shown in FIG. 21, because of twisting by extruding the end of the wire 4 outward of the head 28, after the loop 62 is twisted, this portion does not project from the twisted portion, and hence the height H in this twisted portion (see FIG. 28) can be set low. That is, when the end of the wire 4 is positioned inside of the guide groove 38 or the cutter 36, to twist the loop 62, the leading end of the wire 4 is rubbed by the inner wall of the guide member 18 when the head 28 rotates, and is bent to project from the twisted portion of the loop 62. The cutter 36 is designed to prevent such protection of the wire 4.

As described herein, since the wire 4 is twisted as being pulled to the both sides of the pin members 37, the height H of the twisted portion is low.

Since the height H of the twisted portion is lowered, when the reinforcing bar 60 is covered with concrete, this twisted portion is not exposed from the concrete, and corrosion of reinforcing bar due to such exposure is prevented.

As mentioned above, when a constant torque acts on the second annular portion 25, and the loop 62 is twisted until the current flowing in the second motor 21 reaches the upper limit, the second motor 21 stops, and further begins to rotate reversely, and returns to the first state. That is, by the second motor 21, the first male thread member 22 rotates in reverse direction, and the first annular portion 24 define of its reverse rotation by the first pawl member 26B moves forward. As the first annular portion 24 moves forward, the bar member 32 moves back, and the curved members 2A, 2B are opened, so that the reinforcing bar binding device can be dislocated from the reinforcing bar binding portion. At the same time, the second male thread member 23 also begins to rotate reversely, and the second annular portion 25 defined of reverse rotation moves backward, together with the cutter 36 and pin member 37, without rotating from the position shown in FIG. 17.

Herein, to prevent the twisted portion of the loop 62 from being loosened when twisting of the loop 62 is over and the second male thread member 23 begins to[]rotate reversely, as shown in FIG. 7, the number of protrusions 35B is increased to minimize the angle of reverse rotation of the second annular portion 25.

Consequently, the second annular portion 25 retracts, the engagement of the protrusion 35B and second pawl member 27B is cleared, so that the second annular portion 25 is ready to rotate reversely. Afterwards, as a leaf spring 87 and base part 84 engage each other, the second annular portion 25 begins to rotate reversely together with the second male thread member 23 rotating reversely. Until the second annular portion 25 rotates a full turn at maximum, the protrusion 35A and pawl member 27B are engaged with each other, and the second annular portion 25 returns to the initial rotation angle sate. As for the second motor 21, when the second annular portion 25 reaches near the position where the engagement state of the protrusion 35B and second pawl member 27B is cleared, the arrival at this position is detected by a sensor not shown, and a stop signal is issued to the second motor 21 rotating reversely. The second motor 21 continues t rotate somewhat by inertia after the output of the stop signal, and the leaf spring 87 and base part 84 repeat the state shown in FIG. 18 and FIG. 19, and stop thereafter. That is, the reinforcing bar binding device returns to the initial state shown in FIGS. 1 to 3.

In this way, by one pushbutton operation, the reinforcing bar binding device works sequentially from the first state to the fifth state, and returns to the first state and stops.

What is claimed is:

1. A reinforcing bar binding device comprising a main body, and a loop forming unit having a pair of curved members with grooves disposed at the leading end of the main body so as to be free to open and close, wherein the main body comprises a wire feeder for forming a loop of wire by feeding a wire into the grooves of the pair of curved members in a closed state so as to enclose the intersection of reinforcing bars, and a driving mechanism for opening or closing the pair of curved members, and, after the loop is formed by the wire feeder, advancing and retracting a cutter for cutting off the wire being sent out to the grooves, twisting the formed loop, and advancing, retracting and rotating a pair of pin members disposed at an interval for binding the reinforcing bar by the wire, sequentially, the driving mechanism comprising a motor.

2. A reinforcing bar binding device of claim 1, further comprising a link mechanism operating and synchronizing the pair of curved members with each other, and wherein the driving mechanism further comprises a first male thread member driven and rotated by the motor, a second male thread member disposed parallel to the first male thread member, driven and rotated by the motor through the first male thread member, a first annular portion having a female thread portion for engagement with the first male thread member, and plural protrusions extending in the axial direction on the outer circumference thereof, for moving in the direction away from the loop forming unit by normal rotation of the first male thread member, the first annular portion being coupled to the link mechanism through an intermediate member so that the movement of the first annular portion away from the loop forming unit causes the curved members to close and the movement of the first annular portion toward the loop forming unit causes the curved members to open, a second annular portion having a female thread portion for engagement with the second male thread member and plural protrusions extending in the axial direction on the outer circumference, thereof for moving in the direction toward the loop forming unit when the second male thread member rotates along with the normal rotation of the first male thread member, the second annular portion being movable to and fro and rotatable together with the cutter and the pin members so that the forward movement of the second annular portion toward the loop forming unit causes the cutter to advance beyond a position where the wire is cut and causes the pin members to protrude for twisting the loop, a pair of first pawl members for engagement with and disengagement from the protrusions of the first annular portion, the first pawl members preventing the first annular portion from rotating normally while allowing the first annular portion to move axially in a first state which is an initial state before the binding of reinforcing bars takes place, and, in a second state, allowing the first annular portion, which after moving from the position in the first state, is prevented from moving backward as a result of coming in contact with a rear stopper, to move forward and preventing reverse rotation while allowing normal rotation of the first annular portion, and holding the second state in third, fourth and fifth state, a pair of second pawl members for engagement with and disengagement from the protrusions of the second annular portion, the second pawl members preventing the rotation of the second annular portion while allowing the second annular portion to move axially in the first, second and third states, the second pawl members allowing the second annular portion to rotate in the same direction as the second male thread member normally rotating together with the first male thread member while preventing the rotation of the second annular portion in the opposite direction, and, in the fourth and fifth states, allowing the second annular portion, which after moving from the position in the third state, is prevented from moving in the forward direction as a result of coming in contact with a front stopper, to move in the backward direction, and a head having a guide unit for slidable insertion of the cutter and pin members, and a guide groove formed in the front surface thereof for guiding the wire toward the wire entrance of the loop forming unit on the front surface, the head being rotatable together with the pin members, wherein normal rotation of the first male thread member from the first state in which the first annular portion is at the advanced position and the second annular portion is at the retracted position changes the device into the second and third states, further normal rotation of the first male thread member changes the device into the fourth state, further normal rotation of the first male thread member changes the device into the fifth state, and the subsequent reverse rotation of the first male thread member changes the device into the first state.

3. A reinforcing bar binding device of claim 2, wherein the guide groove in the head slopes forward along a wire advancing direction, and wherein an overhang is formed on one of opposing side walls of the groove above the groove, at the forward side when the head rotates for twisting the loop overhanging the groove at the wire exit.

4. A reinforcing bar binding device of claim 3, wherein the front part of the head unit at both the wire entrance and exit of the guide groove is formed as a slope so that one of opposing the side walls of the guide groove that is at the forward side when the head rotates for twisting the loop gradually lowers radially outwardly.

5. A reinforcing bar binding device of claim 1, wherein the loop forming uhit comprises a stationary guide member is provided at a wire entrance of one of the curved members, the guide member having a guide surface inclined in substantially the same direction as the bottom of the groove of said one of the curved members at the wire entrance to form a step deeper in the wire advancing direction.

6. A reinforcing bar binding device of claim 1, wherein each of the curved members has a groove tapered along the wire advancing direction.

7. A reinforcing bar binding device of claim 2, wherein the intermediate member comprising a first member movable integrally with the first annular portion and provided rotatably, relatively to the first annular portion, and a second member for operating the link mechanism directly, being operating in the same direction as the moving direction of the first member, by the first member through a spring whether the first member moves in normal direction or reverse direction.

8. A reinforcing bar binding device of any one of claims 2, 3, or 4, wherein the wire feeder has a guide member piercing guide through hole for guiding the wire into the guide groove at the wire exit side of a pair of grooved gears for pinching and sending out the wire, the through hole extending obliquely both in a plane including the longitudinal axis and in a plane normal to the longitudinal axis.

9. A reinforcing bar binding device of claim 1, wherein the motor is operated by a direct-current power source, and is limited in the torque so that its current may be lower than a preset value.

10. A reinforcing bar binding device of claim 2, wherein the front part of the head unit is formed as a slope so that the side wall of the guide groove may be lower toward the end portion, in the inlet side and outside side follower side portions when the head rotates for twisting the loop.

11. A reinforcing bar binding device of claim 10, wherein the wire feeder has a guide member piercing guide through hole for guiding the wire into the guide groove, at the wire exit side of a pair of grooved gears for pinching and sending out the wire, the through hole extending obliquely both in a plane including the longitudinal axis and in a plane normal to the longitudinal axis.

* * * * *